US011607786B2

(12) United States Patent
Peng et al.

(10) Patent No.: US 11,607,786 B2
(45) Date of Patent: Mar. 21, 2023

(54) FASTENING TOOL HAVING A TOOL-FREE DEPTH ADJUSTMENT MECHANISM

(71) Applicant: Black & Decker, Inc., New Britain, CT (US)

(72) Inventors: Wei-Chih Peng, Taichung (TW); Yao-Te Yang, Taichung (TW)

(73) Assignee: Black & Decker, Inc., New Britain, CT (US)

( * ) Notice: Subject to any disclaimer, the term of this patent is extended or adjusted under 35 U.S.C. 154(b) by 94 days.

(21) Appl. No.: 16/975,758

(22) PCT Filed: Mar. 1, 2019

(86) PCT No.: PCT/US2019/020259

§ 371 (c)(1),
(2) Date: Aug. 26, 2020

(87) PCT Pub. No.: WO2019/169250

PCT Pub. Date: Sep. 6, 2019

(65) Prior Publication Data

US 2020/0398414 A1 Dec. 24, 2020

Related U.S. Application Data

(60) Provisional application No. 62/637,569, filed on Mar. 2, 2018.

(51) Int. Cl.
*B25C 1/04* (2006.01)
*B25C 1/18* (2006.01)

(52) U.S. Cl.
CPC ..... *B25C 1/047* (2013.01); *B25C 1/041* (2013.01); *B25C 1/188* (2013.01)

(58) Field of Classification Search
CPC ..... B25C 1/047; B25C 1/041; B25C 1/188; B25C 1/008
See application file for complete search history.

(56) References Cited

U.S. PATENT DOCUMENTS 5,261,587 A * 11/1993 Robinson ..... B25C 1/08 227/8
5,564,614 A * 10/1996 Yang ..... B25C 1/047 227/8

(Continued)

FOREIGN PATENT DOCUMENTS

| | | |
|---|---|---|
| JP | 06278052 | 10/1994 |
| WO | 2009096395 A1 | 8/2009 |
| WO | 2012111466 A1 | 8/2012 |

OTHER PUBLICATIONS

Written Opinion of the International Searching Authority, dated Mar. 2, 2018, in corresponding PCT application No. PCT/US2019/020259.

*Primary Examiner* — Joshua G Kotis
(74) *Attorney, Agent, or Firm* — Rhonda Barton

(57) ABSTRACT

A fastening tool having a depth adjustment mechanism mounted on a longitudinally movable door of a nosepiece assembly. The depth adjustment mechanism including a depth adjustment wheel having an internal threaded section extending along an axis and being rotatable about said axis; and an adjustment screw disposed within the depth adjustment wheel and engaging the door plate, the adjustment screw having an external threaded section that engages the internal threaded section of the depth adjustment wheel, so that a rotational movement of the depth adjustment wheel with respect to the adjustment screw effects a relative axial movement of the adjustment screw and the longitudinal movement of the door to increase and decrease the depth that a fastener is driven into a workpiece.

18 Claims, 13 Drawing Sheets

(56) References Cited

U.S. PATENT DOCUMENTS

| | | | | |
|---|---|---|---|---|
| 5,839,638 | A | 11/1998 | Ronn | |
| 6,024,267 | A | 2/2000 | Chen | |
| 6,581,815 | B1 | 6/2003 | Ho et al. | |
| 8,464,806 | B2 | 6/2013 | Rousson et al. | |
| 8,556,148 | B2 | 10/2013 | Schell et al. | |
| 9,427,857 | B2 | 8/2016 | Kok | |
| 2004/0238593 | A1* | 12/2004 | Tachihara | B25C 1/008 227/142 |
| 2008/0023516 | A1* | 1/2008 | Chang | B25C 1/008 227/8 |
| 2008/0099525 | A1* | 5/2008 | Brendel | B25C 1/06 227/8 |
| 2009/0001119 | A1* | 1/2009 | Osuga | B25C 1/008 227/10 |
| 2010/0237125 | A1* | 9/2010 | Jang | B25C 1/008 227/8 |
| 2010/0327037 | A1 | 12/2010 | Zhang et al. | |
| 2012/0305624 | A1* | 12/2012 | Liao | B25C 1/188 227/142 |
| 2013/0119107 | A1* | 5/2013 | Cheung | B25C 1/188 227/139 |

* cited by examiner

FASTENING TOOL HAVING A TOOL-FREE DEPTH ADJUSTMENT MECHANISM

CROSS-REFERENCE TO RELATED APPLICATIONS

The present application is a continuation of international application PCT/US2019/020259 filed on Mar. 1, 2019 which claims priority under 35 U.S.C. § 119 to U.S. Provisional Application Ser. No. 62/637,569 filed on Mar. 2, 2018, which is herein incorporated by reference in its entirety.

BACKGROUND OF THE INVENTION

Field of the Invention

The present invention relates, in general, to the field of power tools. In particular, the present invention relates to portable fastening or driving tools, such as nailers and staplers and more particularly to improvements in such tools for clearing the drive track of a jammed fastener. The present invention also relates to controlling the depth of drive of a fastener into a workpiece.

Description of the Related Art

Different types of fastening tools are known including portable pneumatically actuated devices, electrically actuated devices, hammer actuated devices, manual actuated devices, etc. Fastening tools, such as power nailers have become relatively common place in the construction industry. Pneumatically-powered nailers, which are connected to an air compressor via an air hose, are popular in the market.

Many different types of fastening tools are known including but not limited to portable pneumatically actuated devices, electrically actuated devices, hammer actuated devices and manually actuated devices. A common characteristic of all these types of fastening tools is the provision of a drive track, a fastener driving element mounted in the drive track and a magazine assembly for receiving a supply of fasteners in stick formation and feeding successive leading fasteners in the stick laterally into the drive track to be driven outwardly thereof through a nosepiece assembly by the fastener driving element.

Fastening tools for installing fasteners, such as nails and staples, often time employ a depth adjustment mechanism to permit the user to vary a depth to which a fastener may be installed. This adjustment permits the user to install the fastener to a satisfactory depth despite various variables, including the length of the fastener, the relative hardness of the workpiece into which the fastener is to be driven, etc.

Ideally, a depth adjustment mechanism is relatively simple to operate, provides a wide range of adjustment settings and is relatively inexpensive to fabricate and install to the fastening tool. While the known adjustment mechanisms are satisfactory for their intended purpose, they are nonetheless susceptible to improvement to thereby better achieve the aforementioned goals. Accordingly, there remains a need in the art for an improved depth adjustment mechanism.

There is additionally a need in the art for a nailer that is capable of driving a fastener to a required depth into materials of different hardnesses.

SUMMARY OF THE INVENTION

A depth adjustment mechanism permits a user to select to what extent the fastener is to be driven into the workpiece by selecting the extent to which the door of the nosepiece assembly extends towards/away from the driver housing. Those of skill in the art will appreciate that the depth adjustment mechanism may be formed with a threaded thumb wheel in threaded connection with an adjustment screw so as to effectively linearly move the adjustment screw to extend/retract door of the nosepiece.

In an embodiment, a fastening tool includes a housing, a nosepiece assembly connected to the housing, the nosepiece assembly including a nose portion having a longitudinal body, a door slidably connected to the nose portion by a door plate, the door being biased toward the housing, and a fastener drive track defined between the door and the nose portion. A magazine assembly is provided for feeding fasteners successively to the fastener drive track of the nosepiece assembly. An engine is carried by the housing and configured to drive a fastener along a drive axis out of the fastener drive track and into a workpiece through successive operating cycles each including a drive stroke and a return stroke. The fastening tool further includes a depth adjustment mechanism mounted on the door. The depth adjustment mechanism includes a depth adjustment wheel rotatable about a central axis that extends through the depth adjustment wheel and having an inner surface with a threaded section adjacent to an unthreaded section along the central axis. The depth adjustment mechanism also includes an adjustment screw extending through the depth adjustment wheel and operatively engaging the door plate. The adjustment screw has a head portion and a shank portion that includes a threaded part that engages the threaded section of the depth adjustment wheel. The shank portion further includes an unthreaded part and the threaded part of the shank portion can be disposed between the head portion and the unthreaded part.

As a result, rotational movement of the depth adjustment wheel effects a relative axial movement of the adjustment screw and longitudinal movement of the door with respect to the nose to increase and decrease the depth that a fastener is driven into a workpiece.

In an embodiment, the depth adjustment mechanism is axially movable relative to the nose portion during depth adjusting movement of the adjustment screw. In addition, rotation of the depth adjustment wheel in a first direction moves the adjustment screw toward the housing to press against the door plate to push the door outwardly away from the housing to increase the length of the nosepiece assembly. Further, rotation of the depth adjustment wheel in a second direction, opposite to the first direction, moves the adjustment screw away from the housing and moves the door inwardly toward the housing to reduce the length of the nosepiece.

In an embodiment of the depth adjustment mechanism, the diameter of the head portion of the adjustment screw is greater than the diameter of the shank portion. In addition, the diameter of the threaded section of the depth adjustment wheel is smaller than the diameter of the unthreaded section to limit axial movement of the adjustment screw within the depth adjustment wheel.

In an embodiment, the head portion of the adjustment screw is axially movable within the unthreaded section of the depth adjustment wheel and the shank portion is axially movable within the threaded section of the depth adjustment wheel.

In an embodiment, the fastening tool also includes at least one bracket integral with the door for fixing the depth adjustment mechanism with respect to the door. A second bracket or supporting member can also be included.

In an embodiment, the depth adjustment mechanism further includes a resilient ring member about the adjustment screw for frictionally engaging the depth adjustment wheel to retain the depth adjustment wheel in a desired rotational position with respect to the adjustment screw. The resilient ring member can be disposed between the at least one bracket and the depth adjustment wheel.

In an embodiment, the depth adjustment mechanism can include a rigid ring member operatively connected to the adjustment screw to retain the adjustment screw in the depth adjustment wheel when the wheel is rotated. A substantially circumferential notch on the end of the shank portion can retain the rigid ring member in a fixed axial position with respect to the adjustment screw.

In an embodiment of a depth adjustment mechanism of the present invention, the depth adjustment wheel is rotatable about a central axis that extends through the depth adjustment wheel and has an inner surface with a threaded section adjacent to an unthreaded section along the central axis. The unthreaded section can have a greater diameter than the threaded section. An adjustment screw extends through the depth adjustment wheel and has a head portion and a shank portion. The head portion can be partially disposed within the unthreaded section. The shank portion can have an threaded section on an outer surface thereof that engages the threaded section of the depth adjustment wheel. As a result, rotational movement of the depth adjustment wheel with respect to the adjustment screw effects a relative axial movement of the adjustment screw.

In an embodiment, the head portion of the adjustment screw has a greater diameter than the shank portion of the adjustment screw and the threaded section of the depth adjustment wheel to limit axial movement of the head portion into the depth adjustment wheel.

Additionally, the depth adjustment mechanism can include a resilient ring member about the adjustment screw for frictionally engaging the depth adjustment wheel to retain the depth adjustment wheel in a desired rotational position with respect to the adjustment screw.

Further, the depth adjustment mechanism can include a rigid ring member operatively connected to the adjustment screw to retain the adjustment screw within the depth adjustment wheel when the wheel is rotated.

BRIEF DESCRIPTION OF THE DRAWINGS

The numerous advantages of the present invention may be better understood by those skilled in the art by reference to the accompanying Figures. In the drawings, like reference numerals designate corresponding parts throughout the several views.

Corresponding reference numerals indicate corresponding parts throughout the several views of the drawings.

DETAILED DESCRIPTION OF THE INVENTION

Figure 1:
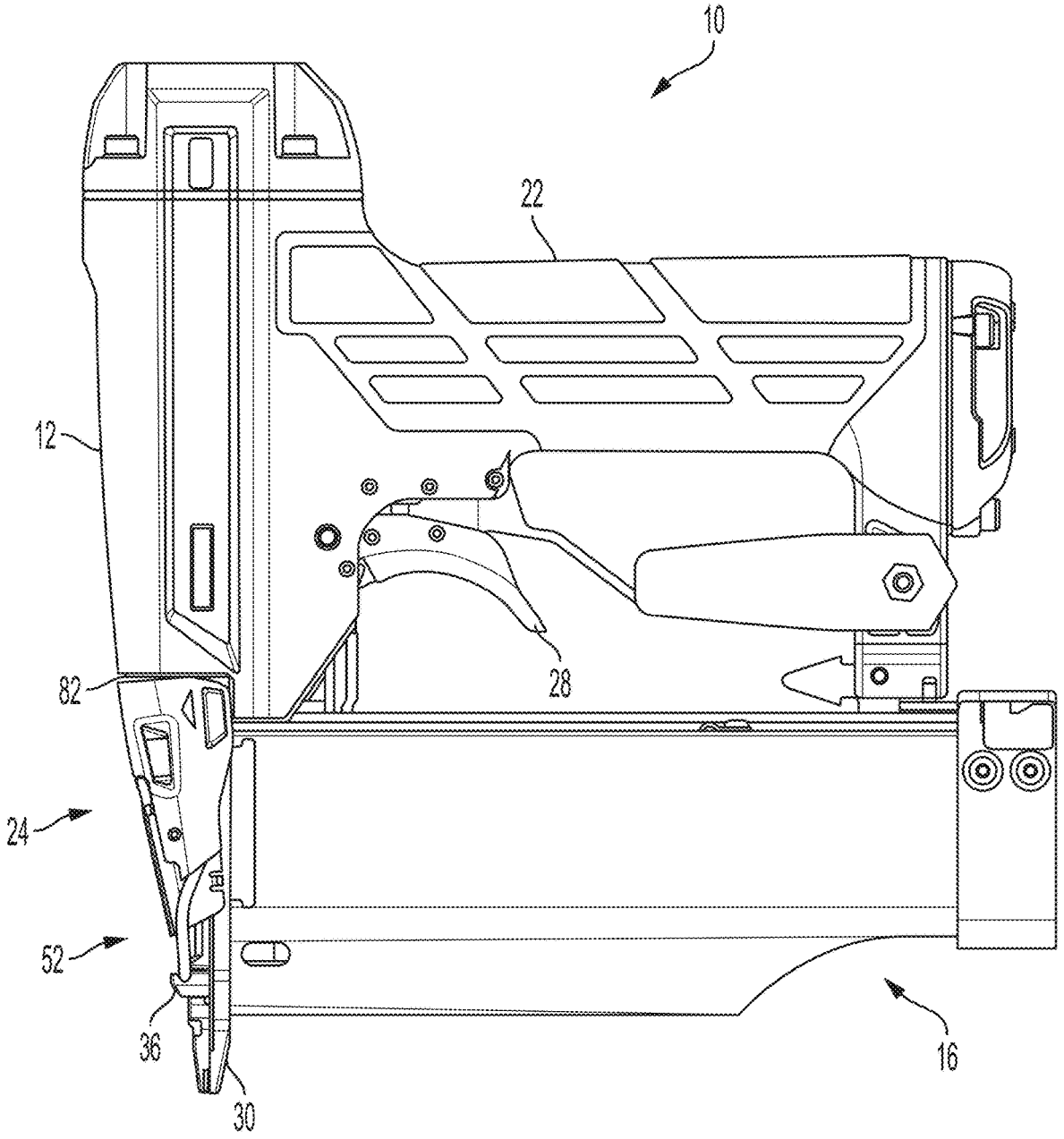
FIG. 1 is a side view of an exemplary fastening tool constructed in accordance with the teachings of the present disclosure and showing a latch mechanism in a latched position.
Figure 2:
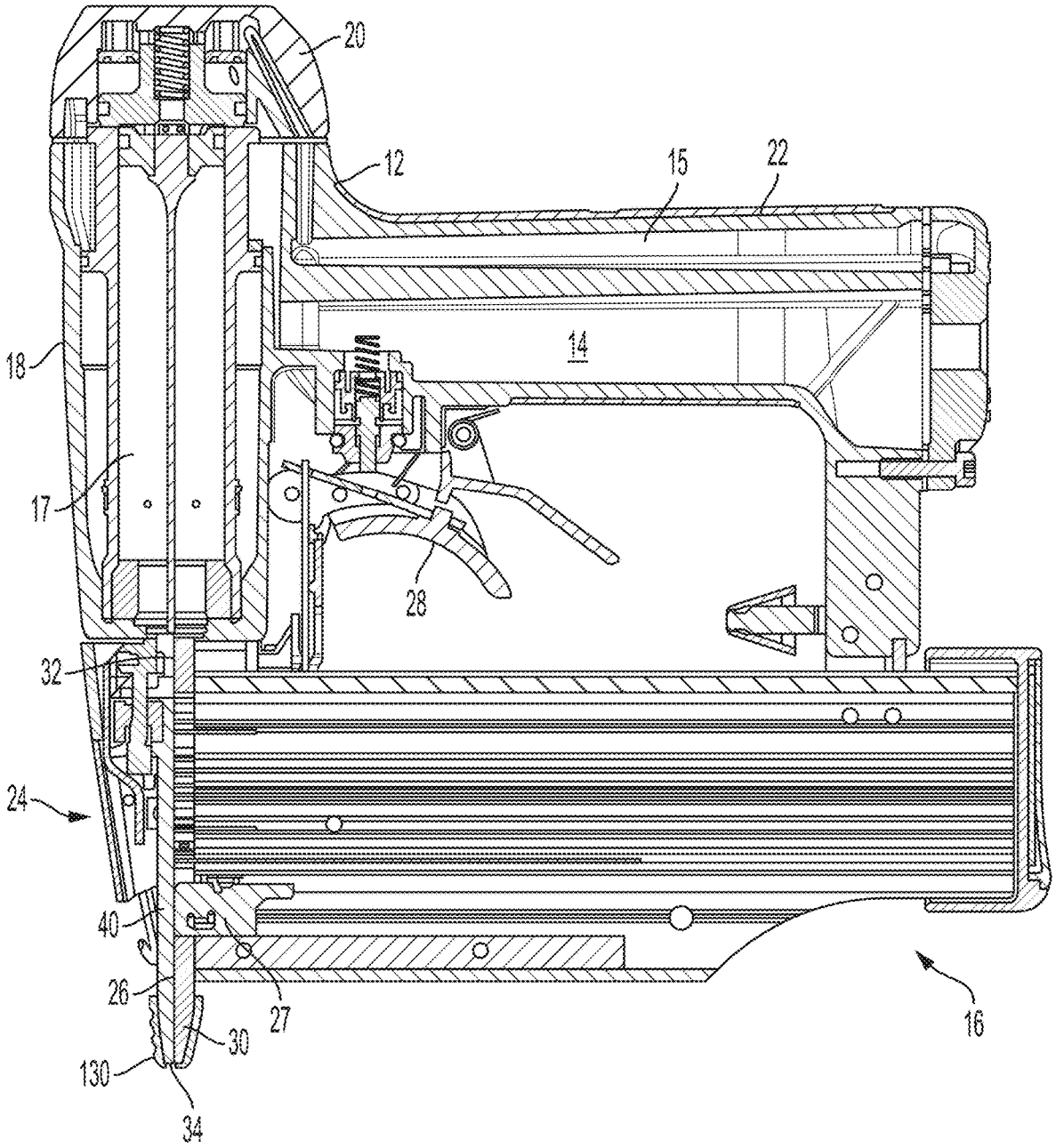
FIG. 2 is a cross-sectional view of the fastening tool of FIG. 1.

FIGS. 1 and 2 illustrate a fastening tool 10 according to an embodiment of the invention.

According to several aspects, the fastening tool 10 is a pneumatically powered nailer, however the fastening tool 10 can be any type of portable tool including a battery operated nailer. The fastening tool 10 includes a housing 12, a nosepiece assembly 24 fixed to the housing 12 and a magazine assembly 16 operatively connected to both the magazine and the nosepiece assembly.

The housing 12 contains components including a pressurized gas reservoir 14, and engine 17 for driving a fastener into a workpiece. The housing 12 defines a reservoir 14 therein. The reservoir 14 is configured to receive a pressurized gas that is used to power the fastening tool 10. In an embodiment, the pressurized gas may be provided to the reservoir 14 from a compressor through a hose. The hose may be connected to the fastening tool 10 via a fitting (not shown) that may be attached to the housing 12. Alternatively, the pressurized gas may be provided to the reservoir 14 through a cartridge. In an embodiment, the pressurized gas may be air that has been compressed by a compressor, as is commonly used in pneumatic tools. It is also contemplated that any gas that releases energy upon expansion, such as a gas produced as a by-product of combustion, or a gas that is produced upon a phase transformation of a liquid, such as carbon dioxide may also be used to power the fastening tool 10. The illustrated embodiment is not intended to be limiting in any way.

As illustrated, the housing 12 includes an engine receiving portion 18 and a cap 20 that is connected to the engine receiving portion 18 at one end. The housing 12 also includes a handle portion 22 that extends from the engine receiving portion 18. As shown, the handle portion 22 may extend substantially perpendicularly from the engine receiving portion 18. The handle portion 22 is configured to be received by a user's hand, thereby making the fastening tool 10 portable. The housing 12 provides a trigger assembly 28 for actuating operation of the fastening tool 10. The housing 12 may be constructed from a lightweight yet durable material, such as magnesium.

The reservoir 14 is substantially defined by the handle portion 22, although it is contemplated that a portion of the reservoir 14 may also be defined by the engine receiving portion 18. In an embodiment, the handle portion 22 may also include a second reservoir 15 that is configured to be open to atmosphere and is configured to allow exhaust gas to exit the fastening tool 10 through the handle portion 22.

Figure 3:
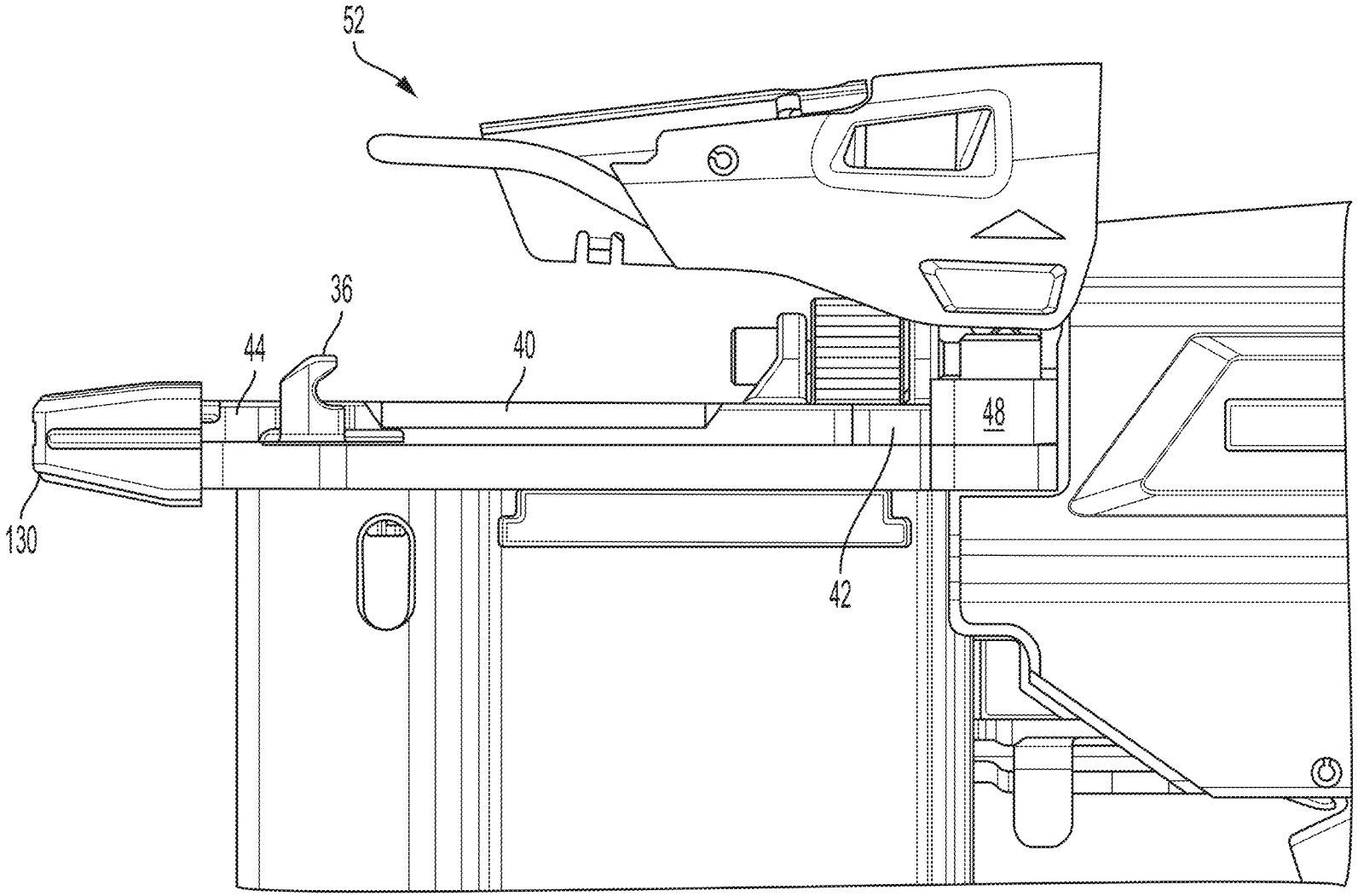
FIG. 3 is a side view of the nosepiece assembly of the fastening tool of FIG. 1.
Figure 4:
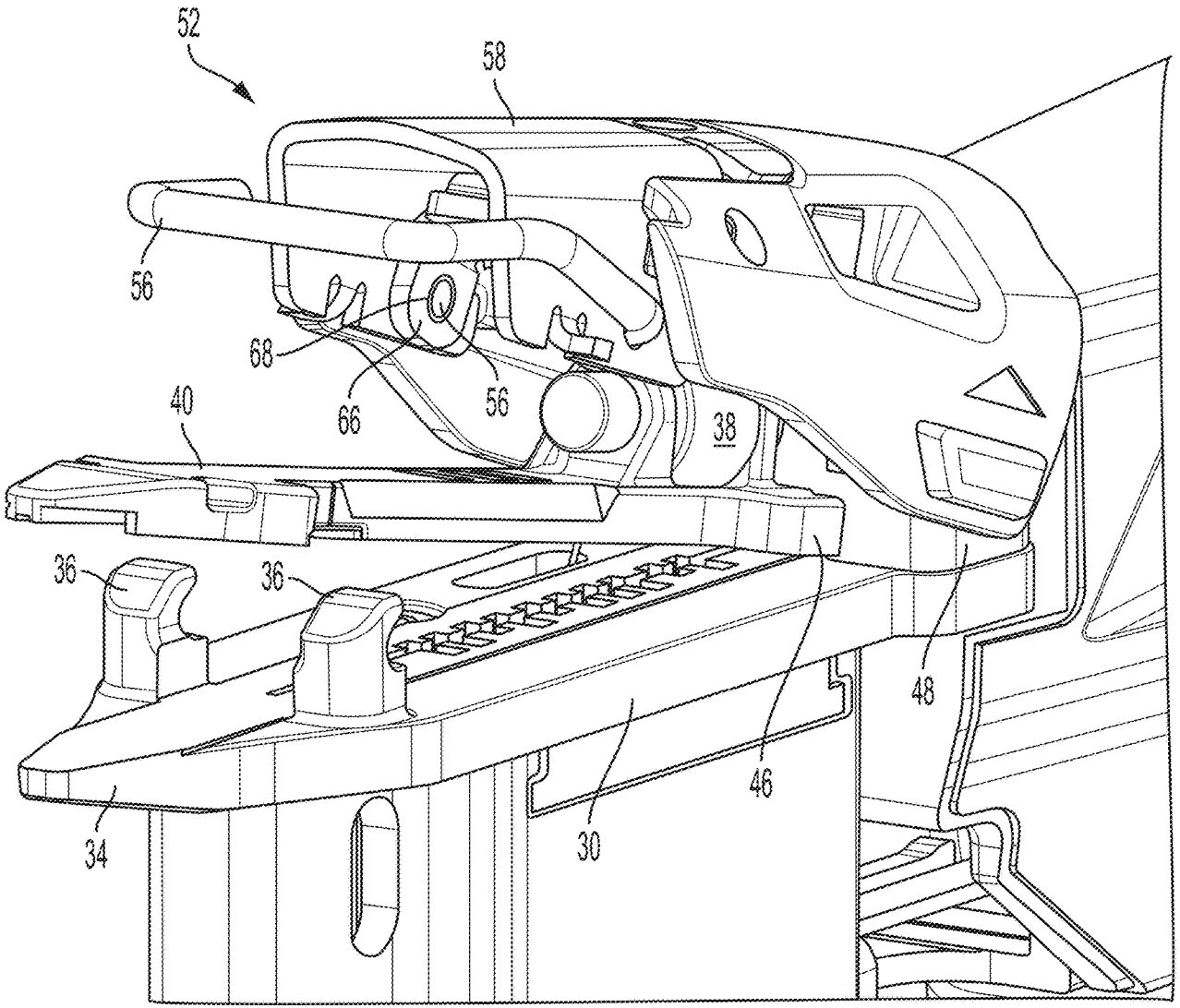
FIG. 4 is a side perspective view of the nosepiece assembly of the fastening tool of FIG. 1.

As illustrated in FIGS. 2, 3 and 4, the fastening tool 10 also includes a nosepiece assembly 24 that defines a fastener drive track 26 and through which fasteners, such as nails, are driven. The nosepiece assembly 24 extends forward of and is connected to both the housing 12 and the magazine assembly 16. The nosepiece assembly 24 includes a nose portion 30 mounted to a backbone structure (not shown) within the housing 12. The nose portion 30 has an elongated body with a longitudinal length that extends between a first end 32 adjacent to the housing 12 and an opposite or second end 34. The second end of the nose portion 30 is a nose tip that can support a no mar tip 130. The no mar tip 130 protects the workpiece surface from indentations caused by the tip or fastener ejection end of the nosepiece assembly on the workpiece when a fastener is driven. The no mar tip can be formed from a resilient material.

The nosepiece assembly 24 also includes a pair of hooks 36 that project outward from a surface of the nose portion 30. The pair of hooks can be integrally formed with the nose portion 30. The hooks 36 are disposed on opposite lateral sides, such as, arranged laterally across the nose portion and can be open or curved toward the housing 12. As such, the hooks can have a concave profile facing the housing. The hooks 36 serve to engage a portion of the latching mechanism in a latched position.

Figure 10:
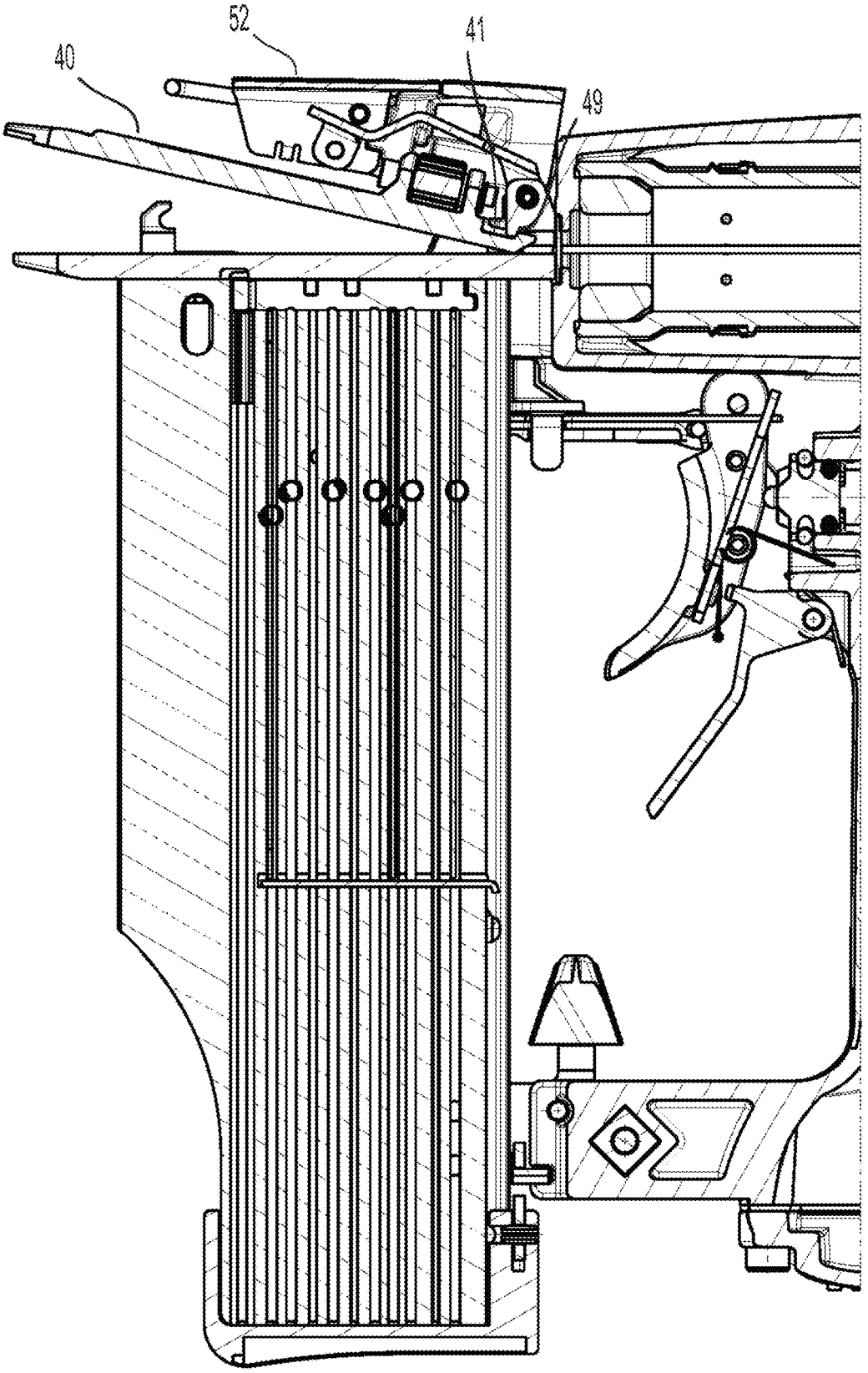
FIG. 10 is a cross-sectional side view of the nosepiece assembly with the latch mechanism in an unlatched position.

A pivoting door 40 is arranged along the longitudinal length of the nose portion 30 between the laterally arranged pair of hooks 36. The door 40 has a rigid body and provides a platform on which a depth adjustment wheel 38 can be mounted. The door 40 has a proximal end 42 adjacent to the housing 12, a distal end 44 that can engage the no mar tip 130, and laterally projecting flanges 46. The proximal end 42 of the door 40 is sandwiched between a door plate 48 and the nose portion 30. The proximal end 42 of the door 40 includes a lateral groove 41 (FIG. 10) in which a projecting lip 49 of the door plate 48 sits. The projecting lip 49 provides forward and rearward limits on the distance that the door 40 can slide in order to correspond to the selected depth defined by the depth adjustment wheel 38. The door 40 also pivots about the projecting lip 49 of the door plate 48 so that the door can open with respect to the nose portion 30 for the removal of a jammed fastener.

A resilient stop member 50 (See also FIG. 7) projects from an aperture in the nose portion 30 toward the proximal end 42 of the door 40. The stop member 50 engages at least one of a pair of flanges 46 projecting laterally from the proximal end 42 of the door 40. The stop member 50 prevents the door 40 from moving longitudinally beyond a predetermined distance and becoming dislodged from the nosepiece assembly 24. The resilient stop member can be a U shaped spring.

In combination, the nose portion 30 and the door 40 define the fastener drive track through which fasteners pass from the magazine assembly 16 to the ejection end of the nosepiece assembly 24.

Fasteners are temporarily contained in the magazine assembly 16 which can be connected to the nosepiece assembly 24 for feeding individual fasteners from the magazine assembly to the nosepiece assembly. The magazine assembly 16 is constructed and arranged to feed successive leading fasteners from a supply of fasteners contained therein along a feed track and into the drive track 26. The supply of fasteners is urged toward the drive track 26 by a pusher 27 that is biased towards the drive track 26 and engages the last fastener in the supply of fasteners. Although the illustrated magazine assembly 16 is configured to receive fasteners that are collated in a stick configuration, it is also contemplated that a magazine assembly that is configured to accommodate fasteners that are collated in a coil formation may also be used. The illustrated embodiment is not intended to be limiting in any way.

The fastening tool includes a tool-free jam release system in the form of a latch mechanism 52. The latch mechanism 52 is operatively connected to the nosepiece assembly 24 in both a latched position and an unlatched position. As shown in FIG. 2, the latch mechanism 52 is in a latched position. In the latched position, the latch mechanism 52 is disposed along the longitudinal length of the nosepiece assembly 24 and arranged to cover at least a portion of the nosepiece assembly. A portion of the latch mechanism 52 also engages the concave portion of the pair of hooks 36 on the nose position 30. Although a pair of hooks are illustrated other arrangement of holding members including a single holding member are contemplated to engage the latch member 56.

As shown in FIG. 3, the latch mechanism is in an unlatched position. In the unlatched position, the latch mechanism 52 is disengaged from the pair of hooks 36. As a result, the door 40 can be accessed and opened to remove jammed fasteners from the nosepiece assembly 24.

Figure 5:
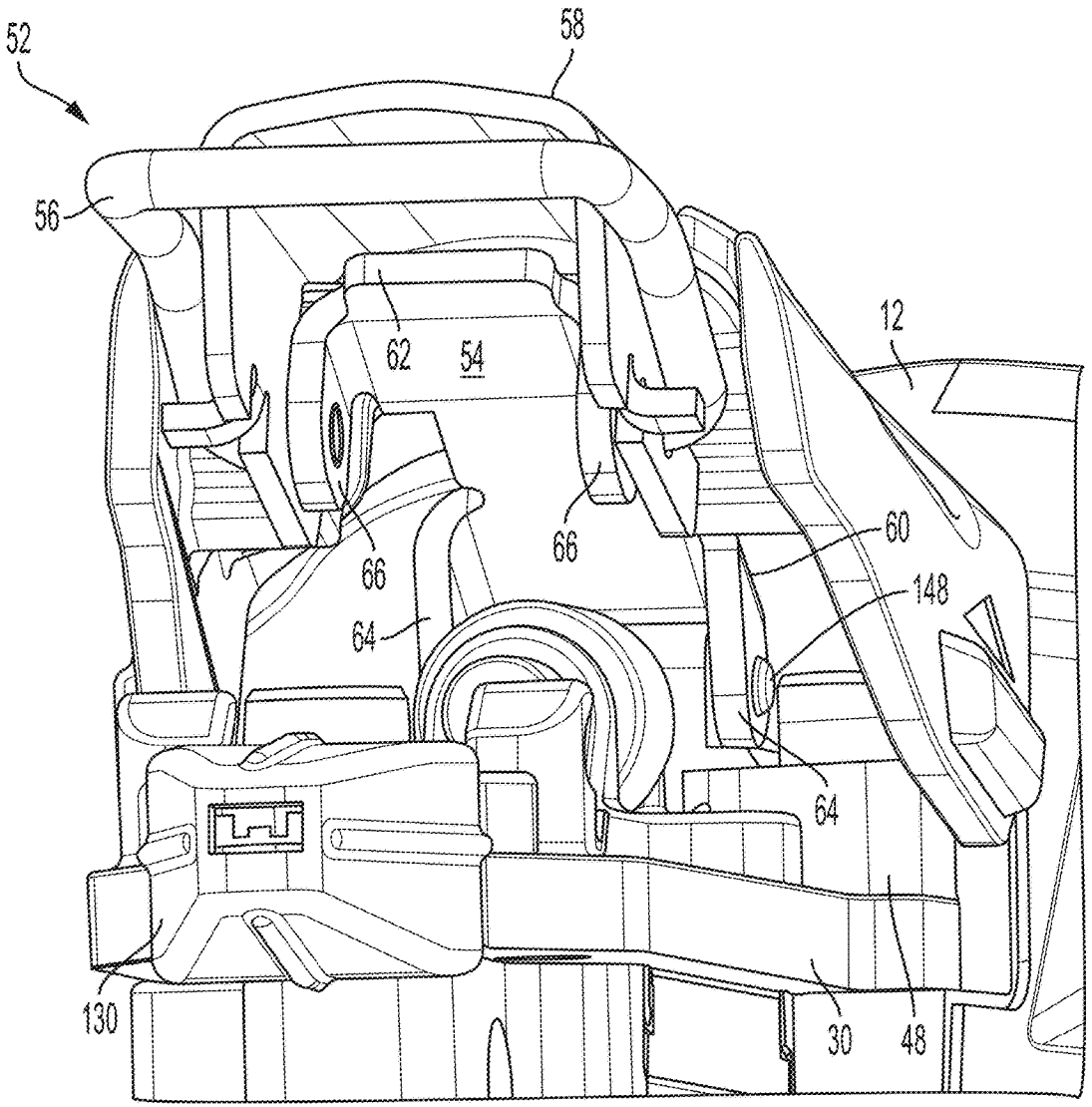
FIG. 5 is a front perspective view of the nosepiece assembly and latch mechanism of the fastening tool of FIG. 1.

As best illustrated in FIGS. 4 and 5, the latch mechanism 52 includes a latch plate 54, a latch member 56 in the form of a latch wire or clip, and a latch cover 58.

The latch plate 54 is disposed within a recess defining the underside of the latch cover 58. The latch plate 54 is an elongated body having a first end 60 and an opposite second end 62 and two pairs of orthogonally projecting or depending rear flanges 64 and forward flanges 66. The pair of depending rear flanges 64 is arranged at the first end 60 of the latch plate 54 and the pair of depending forward flanges 66 is arranged at the second end 62 of the latch plate 54. The flanges 64, 66 are disposed on opposite lateral sides and project from a side of the latch plate 54 opposite the latch cover 58. The first end 60 of the latch plate 54 is pivotally connected to the door plate 48 by a pin 148 that passes through an aperture in each of the pair of projecting flanges. The pin 148 has an axis perpendicular to a drive axis and allows the latch plate 54 to be pivotable toward and away from the nose portion 30 and the door 40. Each of the pair of forward projecting flanges 66 on the second end 62 of the latch plate 54 have apertures 68 through which the latch member 56 is connected thereto. The latch plate 54 has a non-linear profile that creates a space below the latch plate for the depth adjustment wheel 38.

The latch member 56 projects forwardly from the latch plate 54, toward the second end 34 of the nose portion 30 in order to engage the pair of hooks 36. In the latched position, the latch member 56 engages the hooks 36 to secure the latch mechanism 52 on the nose portion 30. In this position, the latch member 56 further exerts or transmits an outward force against the pair of hooks 36 in the direction toward the second end 62 of the nose portion 30. Engagement of the latch member 56 and the pair of hooks 36 creates a compressive stress on the latch mechanism 52.

In the unlatched position, the latch member 56 is disengaged from the pair of hooks 36. The latch member 56 can have a U-shape and be formed from a metal, such as, for example, steel. Although a pair of hooks are illustrated other arrangement of holding members including a single holding member are contemplated to engage the latch member 56.

Figure 6:
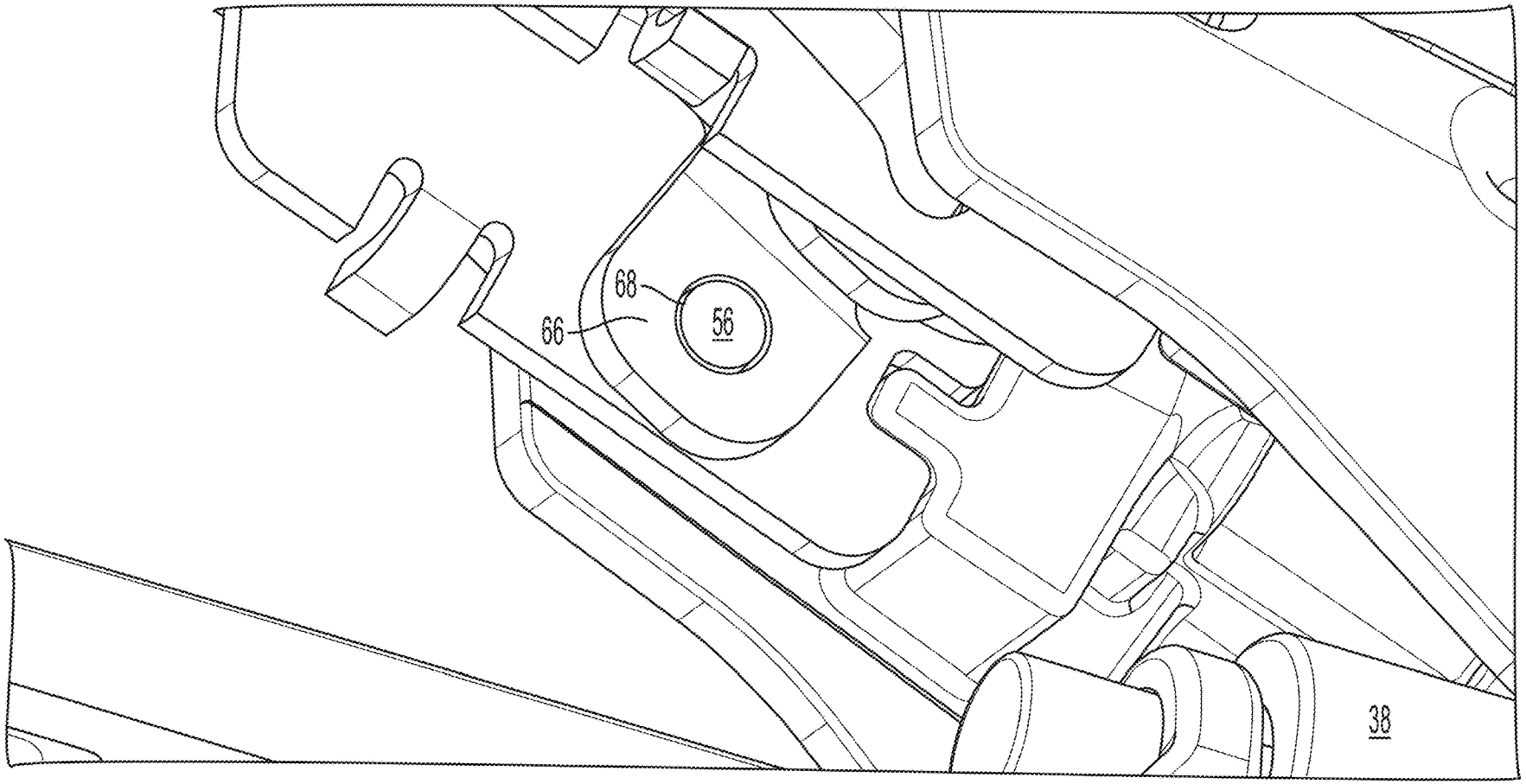
FIG. 6 is an enlarged view of the latch member and latch plate connection.
Figure 7:
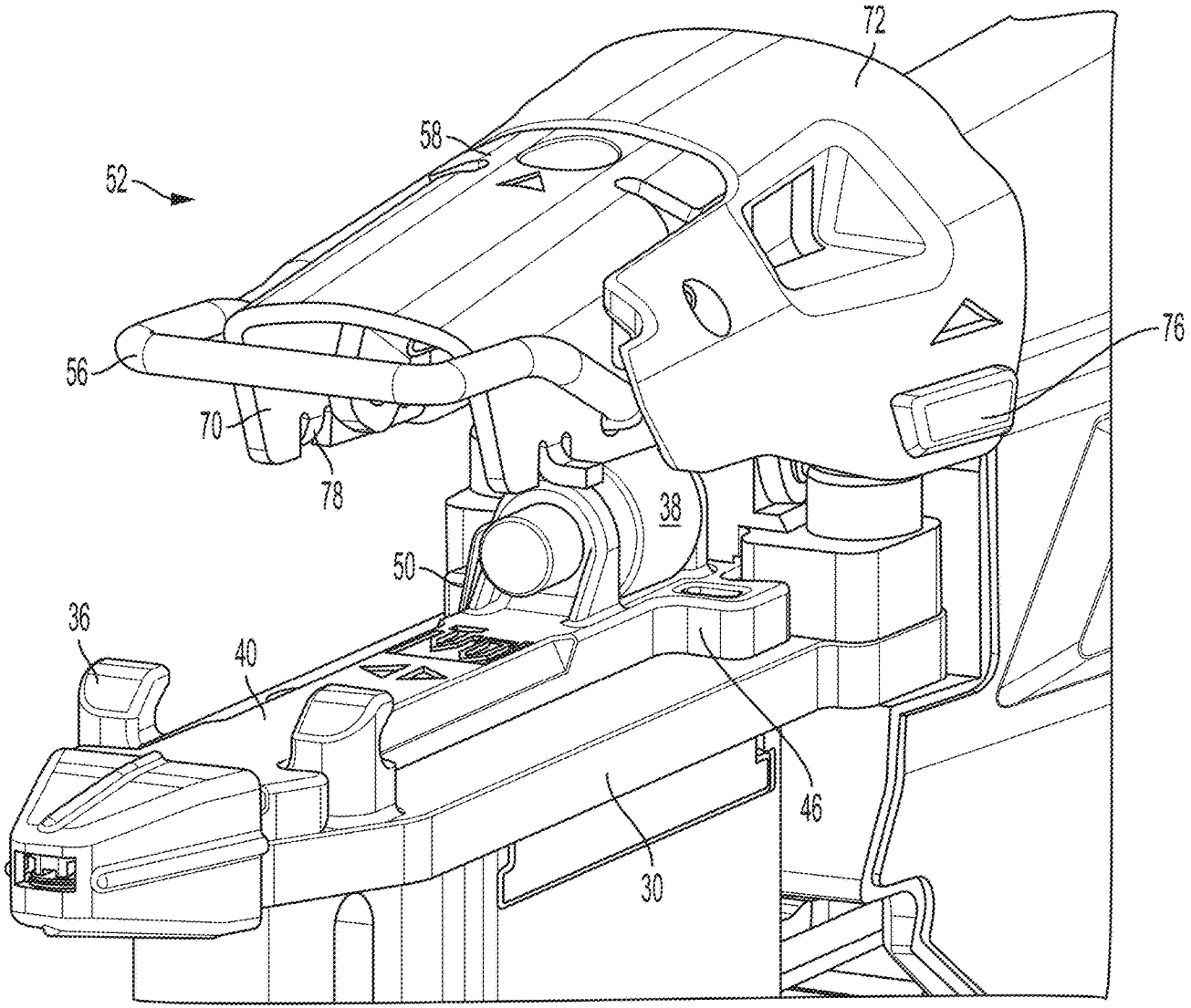
FIG. 7 is a top perspective view of the nosepiece assembly and latch mechanism of the fastening tool of FIG. 1.

With reference to FIGS. 5, 6 and 7, the latch member 56 is pivotally coupled to the latch cover 58, through the same apertures 68 in the latch plate 54.

Figure 8:
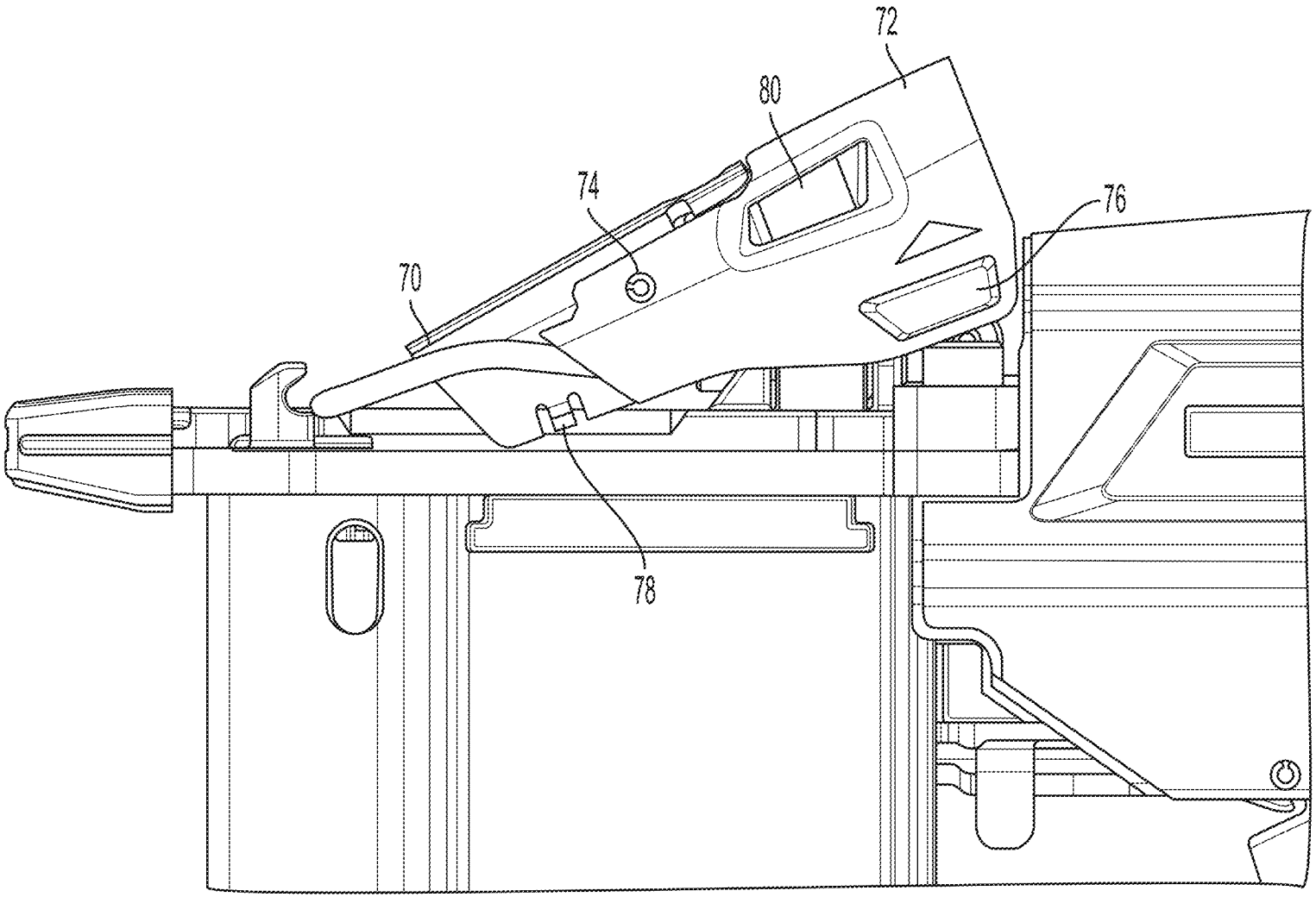
FIG. 8 is a side view of the nosepiece assembly with the latch mechanism in an unlatched position.
Figure 9:
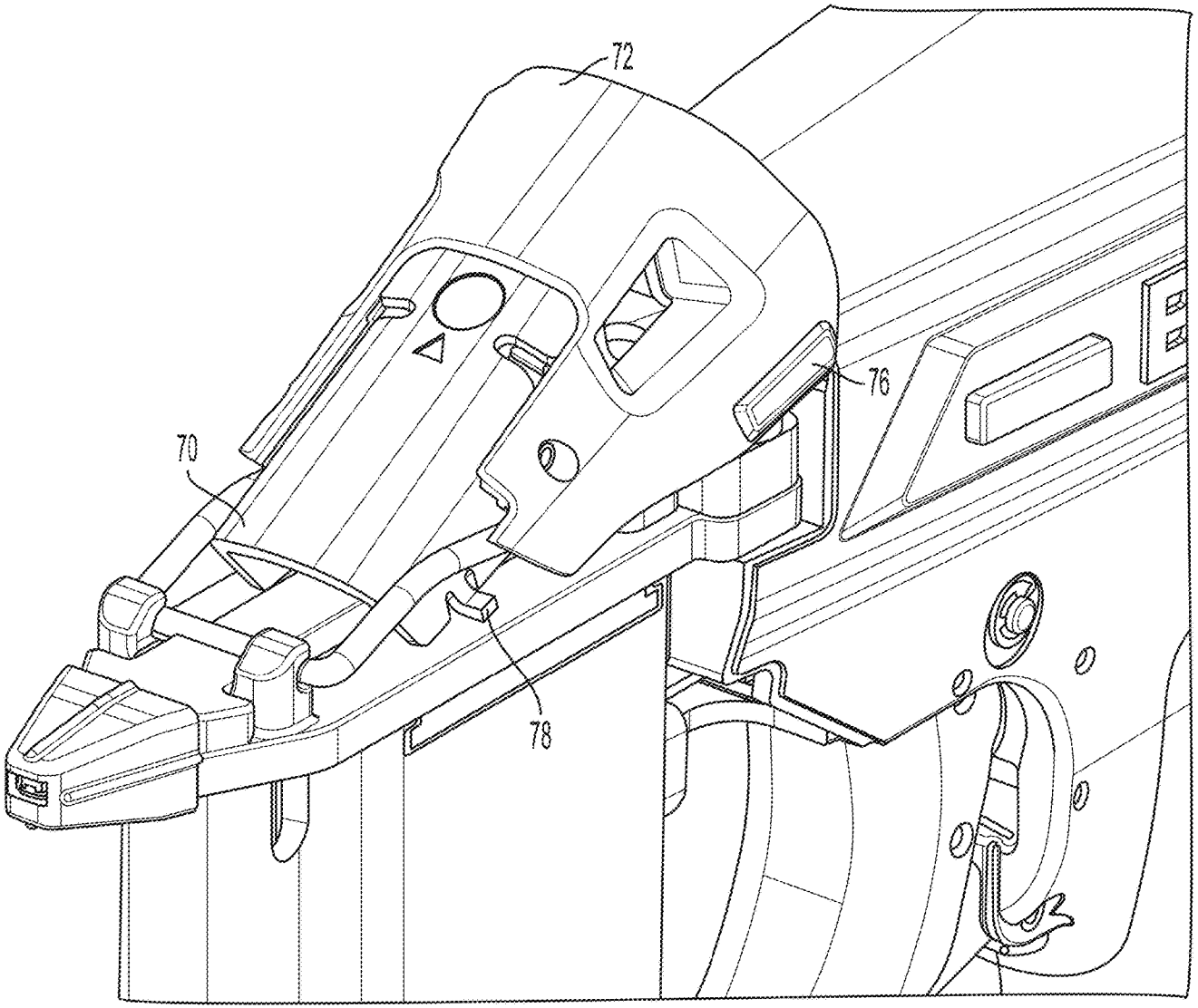
FIG. 9 is a top perspective view of the nosepiece assembly with the latch mechanism in an unlatched position.

In an embodiment, the latch member 56 is formed from a metal and has a resilient body. As shown in FIGS. 7, 8 and 9, a center portion of the latch member 56 is engageable with the hooks 36. The latch member 56 is pivotally supported on the latch plate 54 for spring biased releasable engagement with the hooks 36 thereby latching the latch plate 54 on the nose portion 30. It should be appreciated that various other shaped wires or clips 56 may be employed.

The latch cover 58 can be formed as a rigid body. In an embodiment, illustrated in FIGS. 7, 8 and 9, the latch cover 58 can have a forward portion 70 and a rearward portion 72. The forward portion 70 can be formed from a first material and the rearward portion 72 can be formed from a second material where the first material is different from the second material. For example, the first material can be a metal and the second material can be a plastic. Alternatively, the first and second materials can be two distinct kinds of plastic. In another embodiment, the first material can be the same as the second material. Alternatively, the rigid body can be formed from metal alone.

The forward 70 and rearward 72 portions can be fixed together, such as by being coupled to each other by spring pins 74, as shown in FIG. 8. In a further embodiment, the latch cover 58 can be integrally molded or forged as a single piece of the same material.

In an embodiment where the forward portion 70 is formed from a metal, and the rearward portion 72 is formed from plastic, the metal provides structural rigidity and the plastic provides a cover for a smooth appearance of the front of the tool as well as providing a grasping point for the user to easily lift the latch cover 58 with their fingers. In this regard, the latch mechanism 52 is user friendly and allows the user to open the nosepiece without the use of tools.

In an embodiment, the latch cover 58 can also include a gripping section 76 that defines a location for the user to place their fingers for grasping and lifting the latch cover 58. The gripping section 76 facilitates movement of the latch member 56 from engagement with the pair of hooks 36 to disengagement from the pair of hooks, thereby facilitating movement of the latch mechanism from the latched position to the unlatched position. Lifting the latch cover exposes the door 40 and nose portion 30 and allows the user to remove a fastener that is jammed in the fastener drive track 26. In an embodiment, the gripping section 76 can be a protruding member. In another embodiment, the gripping section can be a substantially planar textured or ribbed surface. In a further embodiment, the gripping section 76 can be a protruding member having a textured or ribbed surface. In an embodiment, the gripping section 76 can be disposed on the rearward portion 72 of the latch cover 58.

The forward portion 70 of the latch cover 58 includes stoppers 78 on opposite lateral sides. The stoppers 78 project outwardly to prevent the latch member 56 from swinging toward the nose portion 30 when the latch mechanism 52 is unlatched, such as when the latch member 56 is disengaged from the pair of hooks 36.

The rearward portion 72 of the latch cover 58 includes a window 80 therethrough for indicating the presence of the depth adjustment wheel 38. The depth adjustment wheel 38 can be accessed when the latch cover 58 is opened.

In operation, when the latch member 52 is in a latched position over the nose portion 30, the latch member 56 is received firmly within the hooks 36 of the nose portion 30. This is due to the latch member 56 having a bend along its longitudinal length. Thus, the length of the latch member 56 is longer than the longitudinal distance the latch member 56 covers along the nosepiece. As a result, the latch member 56 provides a mechanical advantage for tightening the interface between the latch mechanism 52 and the nose portion 30. In the latched position, the center portion of the latch member 56 presses firmly down upon and across the door 40. This arrangement ensures that, in the latched position, the door 40 is secured against the nose portion 30.

Also, in the latched position the latch cover 58 is separated from the housing 12 by a gap 82 (FIG. 2), which gives the latch cover space to pivot when the latch mechanism 52 is in the unlatched position.

To release the door 40, the latch cover 58 is urged away from the door 40, for example, by the user pulling up on the projecting member 76. Urging the latch cover 58 away from the door 40 disengages the latch member 56 from the hooks 36, thus allowing the door 40 to pivot about the projecting lip 49 of the door plate 48 and away from the nose portion 30. In the unlatched position, the user may then clear any jammed fastener from within the nosepiece assembly 24 by pulling the fastener along the longitudinal length of the nose portion 30 toward the nose tip.

Although a wire latch member, as illustrated, can be used to attach the cover to the nosepiece structure, any other element that can connect the latch cover to a nosepiece structure can be used. Lifting the rearward portion 62 of the latch cover releases the bias of the spring in the latched state. As a result, the latch cover can be raised off of the nose portion 30.

When lowered and/or closed, the latch cover 58 conceals the depth adjustment mechanism 100. The depth adjustment mechanism 100 includes the depth adjustment wheel 38, a shaft or adjustment screw 112, a stop member 114, and a ring member 116. The depth adjustment mechanism 100 is configured to change the total length of the nosepiece assembly 24 in order to vary the depth to which a fastener will be driven by the fastening tool 10. In an embodiment, when the depth adjustment wheel 38 is rotated in a first direction, the door 40 moves outwardly to reduce the depth to which a fastener will be driven by the fastening tool. Reducing the depth to which a fastener will be driven into a workpiece by the fastening tool is beneficial for soft woods and soft materials, such as, for example, pine. When the depth adjustment wheel 38 is rotated in a second direction, opposite to the first direction, the door 40 moves inwardly with the assistance of the resilient stop member 50 to increase the depth to which a fastener will be driven into a workpiece by the fastening tool. Increasing the depth to which a fastener will be driven into a workpiece is beneficial for harder woods and materials, such as, for example, oak.

Figure 11:
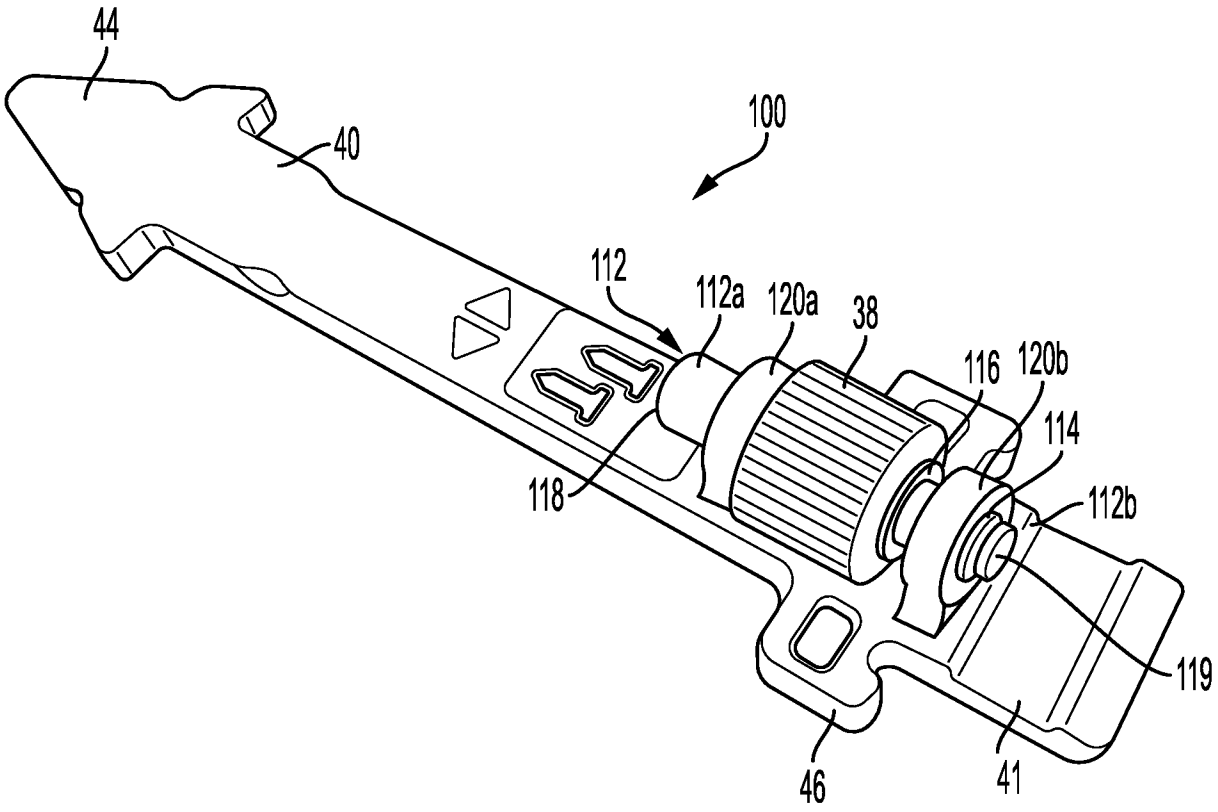
FIG. 11 is a rear perspective view of the depth adjustment mechanism.

As shown in FIG. 11, the depth adjustment wheel 38 can have a hollow cylindrical body with an inner surface defined by an aperture 138 centrally therethrough. The aperture 138 has a first diameter portion **138*a* and an adjacent second diameter portion 138*b*. In an embodiment, the first diameter portion 138*a* is larger than the second diameter portion 138*b*. The first diameter portion 138*a* can be an unthreaded section. The second diameter portion 138*b* can be a threaded section. The first diameter portion 138*b* can be positioned in the nosepiece to face the distal end 44 of the door 40, while the second diameter portion can be positioned to face the proximal end 42 of the door 40. A central or wheel axis 126 through the adjustment wheel 38** is parallel to the drive axis of the tool.

The adjustment screw 112 is disposed within the aperture 138 in the depth adjustment wheel 38 and is coaxial with the depth adjustment wheel.

The adjustment screw 112 has a substantially cylindrical body including a head portion **112*a* at a forward end 118 of the body and tail or shank portion 112***b* at the rearward end 119 of body. The head portion 112*a* is enlarged and has a greater diameter than the second diameter portion 138*b* of the depth adjustment wheel 38. The enlarged head portion 112*a* of the adjustment screw 112 can move within the first diameter portion of the depth adjustment wheel 38 and is prevented from entering the second diameter portion. As a result, the enlarged head portion limits the rearward axial position of the depth adjustment mechanism 100 when the depth adjustment wheel 38 is rotated in a direction to reduce the depth of the fastener fired.

Figure 13:
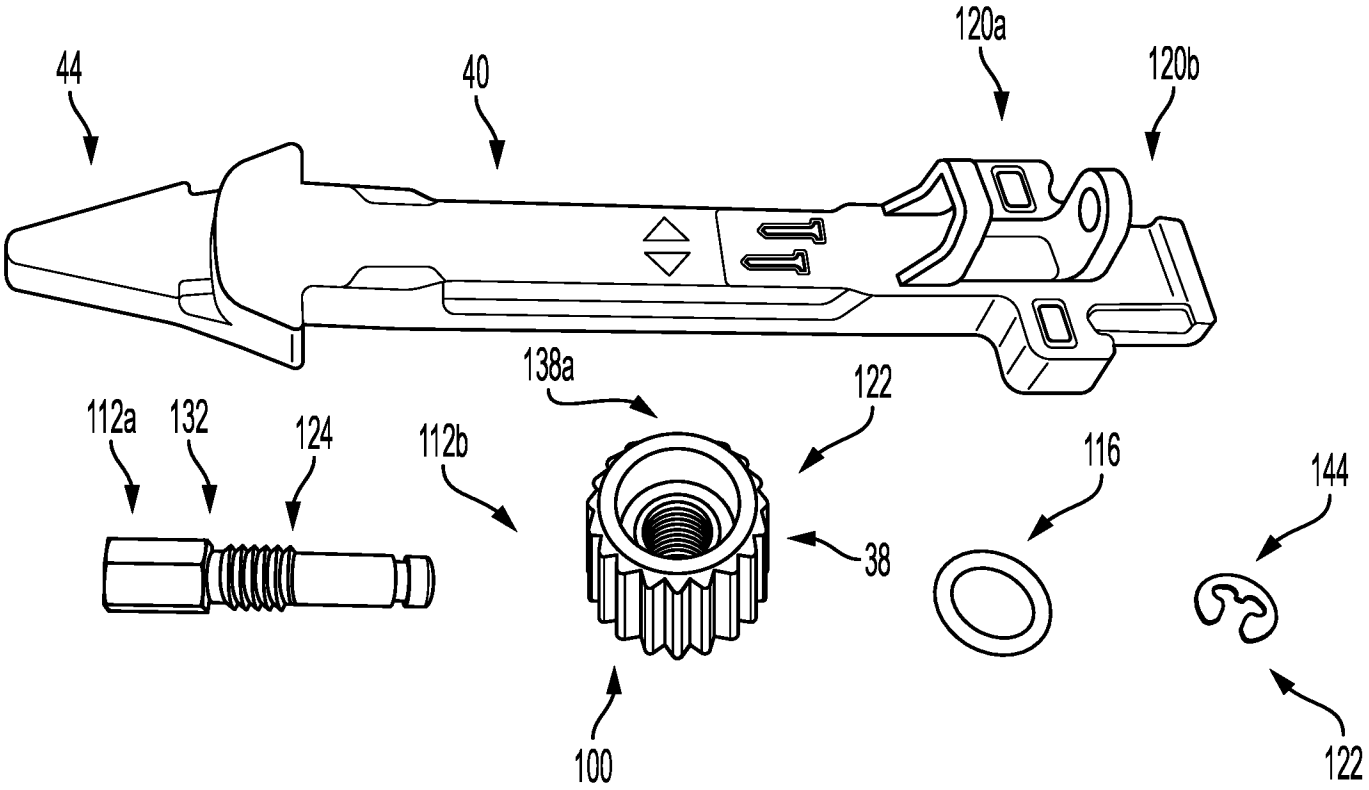
FIG. 13 illustrates an exploded view of a second embodiment of the depth adjustment mechanism of the present invention.

The shank portion has a threaded section 124 on an outer surface thereof that engages the threaded section 138*b* of the depth adjustment wheel 38, so that a rotational movement of the depth adjustment wheel with respect to the adjustment screw effects a relative axial movement of the adjustment screw and longitudinal movement of the door 40 with respect to the nose to increase and decrease the depth that a fastener is driven into a workpiece. The smaller diameter shank portion 112*b* of the adjustment screw 112 can have a stop member 114 disposed thereon to limit the forward axial position of the depth adjustment mechanism when the depth adjustment wheel 38 is rotated in a direction to increase the depth that the fastener is fired. As such, the stop member 114 fixes the depth adjustment mechanism 100 in a position and prevents the adjustment screw 112 from rotating out of the depth adjustment wheel 38. In an embodiment, the stop member can be a rigid member, such as an E-ring, as illustrated in FIGS. 11 and 13. The adjustment screw can be disposed with a substantially circumferential notch in the shank portion for receiving the stop member 114.

Additionally, the ring member 116, prevents the depth adjustment wheel 38 from rotating when the tool is driving a fastener. In particular, the ring member 116 frictionally engages the depth adjustment wheel to retain the depth adjustment wheel in a desired rotational position with respect to the adjustment screw. In an embodiment, the ring member 116 can be an O-ring having elastomeric properties.

The depth adjustment mechanism 100 is mounted to the door 40 by forward and rearward mounting brackets 120*a*, 120*b* that are integrally formed on the planar surface of the door 40. The bracket supports the depth adjustment mechanism in a state of non-axial movement with respect to the door 40. The brackets project outwardly from a surface of the door 40 and support the adjustment screw 112. The brackets 120*a*, 120*b* each have an aperture therethough. The forward bracket 120*a* has a larger aperture than the rearward bracket 120*b*; however, the apertures are arranged such that the centers of the respective apertures are aligned. The forward bracket 120*a* is sized to support a clearance fit of the enlarged head portion 112*a* of the adjustment screw 112, while the rearward bracket 120*b* is sized to support a clearance fit of the smaller tail or shank portion 112*b*.

The apertures in the brackets are sized to the different diameters of the adjustment screw 112, to keep debris from entering the aperture 138 of the depth adjustment wheel 38, while still allowing linear movement of the adjustment screw.

Figure 12A:
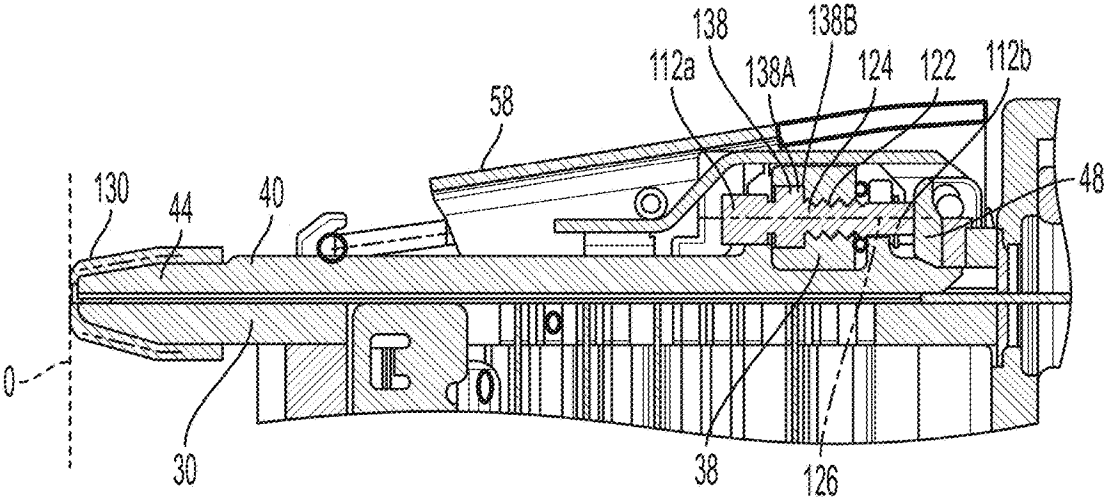
FIGS. 12A and 12B are cross-sectional views of the depth adjustment mechanism in the nosepiece assembly.
Figure 12B:
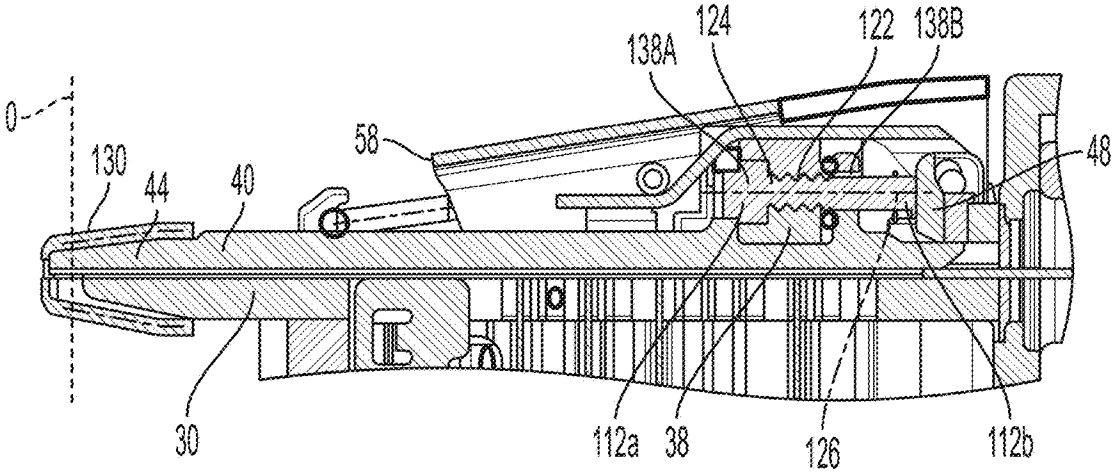

As shown in FIGS. 12A and 12B, the depth adjustment wheel 38 has inner threads 122 that engage outer threads 124 on the adjustment screw 112. The inner threads 122 of the adjustment wheel 38 are arranged to mesh with the outer threads 124 on the outer surface of the adjustment screw so that rotation of the depth adjustment wheel 38 moves the adjustment screw along the wheel axis 126 and effects linear or axial movement of the wheel.

The shank portion 112*b* of the adjustment screw 112 includes a threaded part 124 that engages the threaded section 122 of the depth adjustment wheel 38. In operation, rotation of the depth adjustment wheel 38 in a first direction moves the adjustment screw 112 toward the housing 12 to press against the door plate 48 to push the door 40 outwardly away from the housing to increase the length of the nosepiece assembly. The outward movement of the door is limited by resilient member 50, which biases the door 40 toward the housing 12. The shank portion 112*b* of the adjustment screw 112 moves linearly away from the depth adjustment wheel to push against the door plate 48. The shank portion 112*b* pushing against the door plate 48 causes an opposite movement of the pivoting door 40 outward toward the workpiece to reduce the depth of a driven fastener into the workpiece. As shown in FIG. 12B, the distal end 44 of the door extends beyond an original position indicated by the line O in FIG. 12A.

Further, when the wheel 38 is rotated in a second direction opposite to the first direction, the shank portion 112*b* of the adjustment screw 112 moves away from the door plate 48. As a result, the door 40 moves in a direction away from the workpiece, inwardly toward the housing to reduce the length of the nosepiece, and the depth of the driven fastener is increased.

As the depth adjustment mechanism is disposed on the moving door 40, the mechanism is axially moved relative to the nose portion during the depth adjusting movement of the adjustment screw.

In an embodiment, the shank portion can additionally have an unthreaded part and the threaded part can be disposed between the unthreaded part and the head portion.

The depth adjustment wheel 38 and adjustment screw 112 can be formed from any material, including, but not limited to a metal, such as steel. Additionally, the adjustment screw can have an alternative geometry.

In a second embodiment of the invention as shown in FIG. 13, the head portion of the adjustment screw can have one side that is a planar surface 132. Additionally, the forward bracket that receives the head portion can have an aperture wherein one side is flat and corresponds to the planar surface 132 of the adjustment screw head portion. The planar surface prevents the adjustment screw from self-rotating.

While aspects of the present invention are described herein and illustrated in the accompanying drawings in the context of fastening tool, those of ordinary skill in the art will appreciate that the invention, in its broadest aspects, has further applicability.

It will be appreciated that the above description is merely exemplary in nature and is not intended to limit the present disclosure, its application or uses. While specific examples have been described in the specification and illustrated in the drawings, it will be understood by those of ordinary skill in the art that various changes may be made, and equivalents may be substituted for elements thereof without departing from the scope of the present disclosure. Furthermore, the mixing and matching of features, elements and/or functions between various examples is expressly contemplated herein, even if not specifically shown or described, so that one of ordinary skill in the art would appreciate from this disclosure that features, elements and/or functions of one example may be incorporated into another example as appropriate, unless described otherwise, above. Moreover, many modifications may be made to adapt a particular situation or material to the teachings of the present disclosure without departing from the essential scope thereof. Therefore, it is intended that the present disclosure not be limited to the particular examples illustrated by the drawings and described in the specification as the best mode presently contemplated for carrying out the teachings of the present disclosure, but that the scope of the present disclosure will include any embodiments falling within the foregoing description and claims.

We claim:

1. A fastening tool comprising:

a housing;

a nosepiece assembly connected to the housing, the nosepiece assembly including a nose portion having a longitudinal body, a door slidably connected to the nose portion, and biased toward the housing, a door plate about which the door is pivotably disposed and connected to the nose portion, and a fastener drive track defined between the door and the nose portion;

a magazine assembly for feeding fasteners successively to the fastener drive track of the nosepiece assembly;

an engine carried by the housing and configured to drive a fastener along a drive axis out of the fastener drive track and into a workpiece through successive operating cycles each including a drive stroke and a return stroke; and a depth adjustment mechanism mounted on the door, the depth adjustment mechanism including:

a depth adjustment wheel rotatable about a central axis that extends through the depth adjustment wheel and having an inner surface with a threaded section adjacent to an unthreaded section along the central axis; and an adjustment screw extending through the depth adjustment wheel and operatively engaging the door plate, the adjustment screw having a head portion and a shank portion that includes a threaded part that engages the threaded section of the depth adjustment wheel, so that a rotational movement of the depth adjustment wheel effects a relative axial movement of the adjustment screw and longitudinal movement of the door with respect to the nose portion to increase and decrease the depth that a fastener is driven into a workpiece.

2. The fastening tool according to claim 1, wherein the depth adjustment mechanism is axially movable relative to the nose portion during depth adjusting movement of the adjustment screw.

3. The fastening tool according to claim 1, wherein a diameter of the head portion of the adjustment screw is greater than a diameter of the shank portion.

4. The fastening tool according to claim 3, wherein a diameter of the threaded section of the depth adjustment wheel is smaller than a diameter of the unthreaded section to limit axial movement of the adjustment screw within the depth adjustment wheel.

5. The fastening tool according to claim 1, wherein the shank portion further comprises an unthreaded part.

6. The fastening tool according to claim 5, wherein the threaded part of the shank portion is disposed between the head portion and the unthreaded part.

7. The fastening tool of claim 1, wherein the depth adjustment mechanism further comprises a resilient ring member about the adjustment screw for frictionally engaging the depth adjustment wheel to retain the depth adjustment wheel in a fixed rotational position with respect to the adjustment screw.

8. The fastening tool according to claim 7, further comprising at least one bracket integral with the door for fixing the depth adjustment mechanism with respect to the door.

9. The fastening tool of claim 8, wherein the resilient ring member disposed between the at least one bracket and the depth adjustment wheel.

10. The fastening tool of claim 1, wherein the depth adjustment mechanism further comprises a rigid ring member operatively connected to the adjustment screw to retain the adjustment screw in the depth adjustment wheel when the wheel is rotated.

11. The fastening tool of claim 10, wherein the adjustment screw comprises a substantially circumferential notch on an end of the shank portion to retain the rigid ring member in a fixed axial position with respect to the adjustment screw.

12. A fastening tool comprising:

a housing;

a nosepiece assembly connected to the housing, the nosepiece assembly including a nose portion having a longitudinal body, a door slidably connected to the nose portion by a door plate, the door being biased toward the housing, and a fastener drive track defined between the door and the nose portion;

a magazine assembly for feeding fasteners successively to the fastener drive track of the nosepiece assembly;

an engine carried by the housing and configured to drive a fastener along a drive axis out of the fastener drive track and into a workpiece through successive operating cycles each including a drive stroke and a return stroke; and a depth adjustment mechanism mounted on the door, the depth adjustment mechanism including:

a depth adjustment wheel rotatable about a central axis that extends through the depth adjustment wheel and having an inner surface with a threaded section adjacent to an unthreaded section along the central axis; and an adjustment screw extending through the depth adjustment wheel and operatively engaging the door plate, the adjustment screw having a head portion and a shank portion that includes a threaded part that engages the threaded section of the depth adjustment wheel, so that a rotational movement of the depth adjustment wheel effects a relative axial movement of the adjustment screw and longitudinal movement of the door with respect to the nose portion to increase and decrease the depth that a fastener is driven into a workpiece, wherein rotation of the depth adjustment wheel in a first direction moves the adjustment screw toward the housing to press against the door plate to push the door outwardly away from the housing to increase the length of the nosepiece assembly.

13. The fastening tool of claim 12, wherein rotation of the depth adjustment wheel in a second direction, opposite to the first direction, moves the adjustment screw away from the housing and moves the door inwardly toward the housing to reduce the length of the nosepiece assembly.

14. A fastening tool comprising:

a housing;

a nosepiece assembly connected to the housing, the nosepiece assembly including a nose portion having a longitudinal body, a door slidably connected to the nose portion by a door plate, the door being biased toward the housing, and a fastener drive track defined between the door and the nose portion;

a magazine assembly for feeding fasteners successively to the fastener drive track of the nosepiece assembly;

an engine carried by the housing and configured to drive a fastener along a drive axis out of the fastener drive track and into a workpiece through successive operating cycles each including a drive stroke and a return stroke; and a depth adjustment mechanism mounted on the door, the depth adjustment mechanism including:

a depth adjustment wheel rotatable about a central axis that extends through the depth adjustment wheel and having an inner surface with a threaded section adjacent to an unthreaded section along the central axis; and an adjustment screw extending through the depth adjustment wheel and operatively engaging the door plate, the adjustment screw having a head portion and a shank portion that includes a threaded part that engages the threaded section of the depth adjustment wheel, so that a rotational movement of the depth adjustment wheel effects a relative axial movement of the adjustment screw and longitudinal movement of the door with respect to the nose portion to increase and decrease the depth that a fastener is driven into a workpiece, wherein the head portion is axially movable within the unthreaded section of the depth adjustment wheel and the shank portion is axially movable within the threaded section of the depth adjustment wheel.

15. A depth adjustment mechanism for a fastening tool, the depth adjustment mechanism configured to be mounted on a door of a nosepiece assembly of the fastening tool, wherein the door is slidably connected to a nose portion of the fastening tool by a door plate, the depth adjustment mechanism comprising:

a depth adjustment wheel rotatable about a central axis that extends through the depth adjustment wheel, and having an inner surface with a threaded section adjacent to an unthreaded section along the central axis, the unthreaded section having a greater diameter than the threaded section; and an adjustment screw extending through the depth adjustment wheel and having a head portion and a shank portion, the head portion being partially disposed within the unthreaded section and the shank portion having an threaded section on an outer surface thereof that engages the threaded section of the depth adjustment wheel, so that a rotational movement of the depth adjustment wheel with respect to the adjustment screw effects a relative axial movement of the adjustment screw, wherein the relative axial movement of the adjustment screw operatively engages the door plate to effect a longitudinal movement of the door with respect to the nose portion to increase and decrease the depth to which a fastener is driven into a workpiece.

16. The depth adjustment mechanism according to claim 15, wherein the head portion of the adjustment screw has a greater diameter than the shank portion of the adjustment screw and the threaded section of the depth adjustment wheel to limit axial movement of the head portion into the depth adjustment wheel.

17. The depth adjustment mechanism according to claim 15, further comprising a resilient ring member about the adjustment screw for frictionally engaging the depth adjustment wheel to retain the depth adjustment wheel in a predetermined rotational position with respect to the adjustment screw.

18. The depth adjustment mechanism according to claim 15, further comprising a rigid ring member operatively connected to the adjustment screw to retain the adjustment screw within the depth adjustment wheel when the wheel is rotated.

* * * * *